US008906267B2

(12) United States Patent
Reinhard et al.

(10) Patent No.: US 8,906,267 B2
(45) Date of Patent: Dec. 9, 2014

(54) COMPOSITIONS OF VAPOUR PHASE CORROSION INHIBITORS, METHOD FOR THE PRODUCTION THEREOF AND USE THEREOF FOR TEMPORARY PROTECTION AGAINST CORROSION

(75) Inventors: Georg Reinhard, Dresden (DE); Peter Neitzel, Dresden (DE); Gerhard Hahn, Hann. Munden (DE)

(73) Assignee: Excor Korrosionsforschung GmbH, Dresden (DE)

( * ) Notice: Subject to any disclaimer, the term of this patent is extended or adjusted under 35 U.S.C. 154(b) by 821 days.

(21) Appl. No.: 13/016,589

(22) Filed: Jan. 28, 2011

(65) Prior Publication Data

US 2011/0198540 A1 Aug. 18, 2011

(30) Foreign Application Priority Data

Jan. 28, 2010 (DE) ..... 10 2010 006 099

(51) Int. Cl.
*C09K 3/00* (2006.01)
*C23F 11/00* (2006.01)
*C23F 11/02* (2006.01)

(52) U.S. Cl.
CPC ..... *C23F 11/02* (2013.01); *C10M 2215/042* (2013.01); *C10M 2215/102* (2013.01); *C10M 2215/221* (2013.01); *C10M 2215/223* (2013.01); *C10N 2230/12* (2013.01)
USPC ..... 252/388; 252/387; 252/390; 252/392; 252/394; 252/396

(58) Field of Classification Search
CPC ..... C23F 11/00; C23F 11/02; C23F 11/12; C23F 11/122; C23F 11/14; C23F 11/146; C23F 11/149; C23F 11/141; C10M 2215/042; C10M 2215/102; C10M 2215/221; C10N 2030/12
USPC ..... 252/387, 388, 390, 392, 394, 396
See application file for complete search history.

(56) References Cited

U.S. PATENT DOCUMENTS

| | | | | |
|---|---|---|---|---|
| 2,419,327 | A | 4/1947 | Wachter et al. | |
| 2,432,840 | A | 12/1947 | Wachter et al. | |
| 2,534,201 | A | 12/1950 | Hutter | |
| 3,201,349 | A * | 8/1965 | Quanstrom | 508/176 |
| 3,398,095 | A | 8/1968 | Judd | |
| 3,785,975 | A | 1/1974 | Humphrey et al. | |
| 3,788,992 | A * | 1/1974 | Sullivan | 508/244 |
| 3,836,077 | A | 9/1974 | Skildum | |
| 3,887,481 | A | 6/1975 | Korpics | |
| 3,967,926 | A | 7/1976 | Rozenfeld et al. | |
| 4,012,330 | A * | 3/1977 | Brewster | 508/508 |
| 4,051,066 | A | 9/1977 | Miksic et al. | |
| 4,124,549 | A | 11/1978 | Hashiudo et al. | |
| 4,275,835 | A | 6/1981 | Miksic et al. | |
| 4,290,912 | A | 9/1981 | Boerwinkle et al. | |
| 5,209,869 | A | 5/1993 | Miksic et al. | |
| 5,332,525 | A | 7/1994 | Miksic et al. | |
| 5,393,457 | A | 2/1995 | Miksic et al. | |
| 5,681,506 | A | 10/1997 | Pragnell et al. | |
| 5,958,115 | A | 9/1999 | Bottcher et al. | |
| 6,752,934 | B2 | 6/2004 | Reinhard et al. | |
| 7,014,694 | B1 | 3/2006 | Miksic et al. | |
| 2009/0111901 | A1 | 4/2009 | Allen | |

FOREIGN PATENT DOCUMENTS

| | | | | |
|---|---|---|---|---|
| DE | 10 2007 059 726 | | 7/2009 | |
| EP | 0 639 657 | | 2/1995 | |
| EP | 905221 | A1 * | 3/1999 | C10M 161/00 |
| EP | 1 219 727 | | 7/2002 | |
| GB | 600 328 | | 4/1948 | |
| GB | 919 778 | | 2/1963 | |
| GB | 1 224 500 | | 3/1971 | |
| JP | 61227188 | | 10/1986 | |
| JP | 62063686 | | 3/1987 | |
| JP | 62109987 | | 5/1987 | |
| JP | 63028888 | | 2/1988 | |
| JP | 63183182 | | 7/1988 | |
| JP | 63210285 | | 8/1988 | |
| JP | 06010164 | A * | 1/1994 | |
| JP | 07145490 | | 6/1995 | |
| JP | 09031672 | | 2/1997 | |
| JP | 2002253889 | | 9/2002 | |
| JP | 2005350583 | | 12/2005 | |

OTHER PUBLICATIONS

Vuorinen et al., "Introduction to Vapour Phase Corrosion Inhibitors in Metal Packaging", Surface Engineering, vol. 20, No. 4, (2004), pp. 281-284.

* cited by examiner

*Primary Examiner* — Harold Pyon
*Assistant Examiner* — Tanisha Diggs
(74) *Attorney, Agent, or Firm* — Pearl Cohen Zedek Latzer Baratz LLP

(57) ABSTRACT

The invention relates to substance combinations comprising (1) at least one substituted, preferably polysubstituted, pyrimidine, (2) at least one monoalkylurea, (3) at least one $C_3$ to $C_5$ aminoalkyldiol, and optionally (4) at least one benzotriazole, preferably a benzotriazole which is substituted on the benzene ring. The components may be mixed together or dispersed in water or pre-mixed in a solubiliser that is miscible in any ratio with mineral oils and synthetic oils, such as for example a phenyl alkyl alcohol or an alkylated phenol. Such substance combinations can be used as vapour phase corrosion inhibitors in packagings or during storage in closed spaces for protecting customary utility metals, such as iron, chromium, nickel, tin, zinc, aluminium, copper and alloys thereof, against atmospheric corrosion.

22 Claims, No Drawings

COMPOSITIONS OF VAPOUR PHASE CORROSION INHIBITORS, METHOD FOR THE PRODUCTION THEREOF AND USE THEREOF FOR TEMPORARY PROTECTION AGAINST CORROSION

CROSS-REFERENCE TO RELATED APPLICATIONS

This application claims priority of German Patent Application No. DE 10 2010 006 099.2, filed on Jan. 28, 2010, which is incorporated in its entirety herein by reference.

BACKGROUND OF THE INVENTION

The present invention relates to substance combinations as vapour phase corrosion inhibitors (corrosion inhibitors capable of evaporating or sublimating, vapour phase corrosion inhibitors VPCI, volatile corrosion inhibitors VCI) for protecting customary utility metals, such as iron, chromium, nickel, tin, zinc, aluminium, copper, magnesium and alloys thereof, against corrosion in humid climates.

Already for several decades, use has been made of corrosion inhibitors which tend to evaporate or sublimate even under normal conditions and thus can pass via the gas phase onto metal surfaces that are to be protected, for the temporary corrosion protection of metal objects within closed spaces, e.g. in packagings, switch cabinets or display cases. Protecting metal parts in this way against corrosion during storage and transport is known to be the clean alternative to temporary corrosion protection using oils, greases or waxes.

These corrosion inhibitors which preferably act via the vapour phase are usually selected depending on the type of metal to be protected and are used as a powder, packaged in bags made from a material that is permeable to the VCIs in vapour form (cf. for example: E. Vuorinen, E. Kalman, W. Focke, *Introduction to vapour phase corrosion inhibitors in metal packaging*, Surface Engng. 29 (2004) 281 pp.; U.S. Pat. No. 6,752,934 B2).

Modern packaging materials for corrosion protection contain the VCIs either as powder or tablets inside gas-permeable containers (e.g. paper bags, plastic capsules), coatings on paper, cardboard, foams or textile nonwovens, or incorporated directly within polymeric carrier materials. For instance, the patents U.S. Pat. Nos. 3,836,077, 3,967,926, 5,332,525, 5,393,457, 4,124,549, 4,290,912, 5,209,869, JP 2002253889 A, EP 0,639,657, EP 1,219,727, U.S. Pat. No. 6,752,934 B2, US 2009/0111901 A1 and DE-OS 102007059 726 A1 propose different variants for introducing the VCIs into capsules, coatings or gas-permeable plastic films so that in each case there is obtained a product from which the VCI components can continuously evaporate or sublimate.

The production of VCI-containing packaging materials by dissolving the VCI components in a suitable solvent and applying to a suitable carrier material is particularly obvious and has already been practised for a long time. Methods of this type using different active substances and solvents are described for example in JP 61,227,188, JP 62,063,686, JP 63,028,888, JP 63,183,182, JP 63,210,285, U.S. Pat. Nos. 3,887,481 and 5,958,115.

Finally, there is an increasing requirement to provide VCI-containing oils. In this case, the films of oil applied to metal surfaces are intended to protect against corrosion not only the metal substrate in question but rather also surface regions of the metals in question which could not be coated with a film of oil due to their geometry (e.g. holes, narrow notches, folded metal-sheet layers), since the VCI components emitted from the oil pass via the vapour phase to the oil-free surface regions within closed spaces (e.g. packages, containers, cavities) and form thereon an adsorption film which protects against corrosion.

Such VCI oils are described for example in the patents GB 919,778, GB 1,224,500, U.S. Pat. Nos. 3,398,095, 3,785,975 and JP 07145490A. Since these VCI oils emit volatile corrosion inhibitors and protect against corrosion via the gas phase even the regions of metal surfaces that are not covered with an oil, they differ considerably from preserving oils in which the corrosion protection properties are improved by the incorporation of non-volatile corrosion inhibitors which are thus effective only in direct contact. Such corrosion protection oils are described for example in the patents U.S. Pat. Nos. 5,681,506 and 7,014,694 B1.

It is known that all measures for the temporary corrosion protection of metals against the effect of neutral aqueous media or condensed water films have the aim of preserving the primary oxide layer (POL), which always exists on utility metals after first contact with the atmosphere, against chemical and mechanical degradation (cf. for example: U.S. Pat. No. 6,752,934 B2 and DE-OS 102007059 726 A1).

Since many amines already have a relatively high vapour pressure or sublimation pressure under normal conditions and are adsorbed in particular onto ferrous materials which are covered with a POL, they have already been put to early use as VCIs and said use is described in many patents. Mention is made primarily therein of the cyclic amines dicyclohexylamine and cyclohexyl-amine. However, in the patents GB 600,328, U.S. Pat. Nos. 2,419,327, 2,432,840, 4,051,066 and 4,275,835 cited by way of example, account is already taken of the fact that no reliable temporary corrosion protection can be obtained using amines alone, and therefore the use of amines is combined with further volatile active substances. One group of substances used for this includes oxidation agents which can act as passivators. Using such passivators, it is possible to achieve the situation whereby the POL is spontaneously recreated as an oxidic top layer on metal substances when it has been destroyed by partial chemical disintegration or local mechanical removal (abrasion, erosion) (cf. for example: E. Vuorinen et al., loc. cit. and U.S. Pat. No. 6,752,934 B2).

As such passivating oxidation agents, the nitrites as salts of nitrous acid have proven useful in practical corrosion protection. They have therefore also already been used for a long time as VCIs. In particular, the relatively readily volatile dicyclohexylammonium nitrite has already been used as a VCI for more than 60 years (cf. for example Vuorinen et al., loc. cit.) and is mentioned as a constituent of VCI compositions in numerous patents (for example: U.S. Pat. Nos. 2,419,327, 2,432,840, 2,534,201, 4,290,912, JP 62109987, JP 63210285 A and U.S. Pat. No. 6,752,934 B2).

However, its effect is more or less limited to the protection of ferrous materials, while the stability of the passive oxide layer of zinc and aluminium materials is often impaired.

With the aim of creating VCI packaging materials which can be used not only for ferrous metals but rather at least also for zinc-plated steels and aluminium materials, it has been proposed to combine nitrite/amine mixtures with further substances capable of sublimating, such as for example the salts of medium to weak, saturated or unsaturated carboxylic acids, cf. for example U.S. Pat. Nos. 2,419,327, 2,432,840. As a result, an improved protection of the customary Al and Zn materials is obtained when these are in contact with an aqueous medium or condensed water film, but at the same time the passivator properties of the nitrite are reduced by these species. It is known that the carboxylates in question build up pH buffer systems with a relatively high buffer capacity in aqueous media or condensed water films on metal surfaces with or without the simultaneous presence of an amine, depending on the respectively present carboxylic acid/salt system, and thus usually hinder the reducibility of oxidation agents. The passivation effect can then be achieved only when the concentration of the oxidation agent in question is set in comparative terms to be much higher than the amounts of the other active substances.

Since nowadays the practical use of said oxidation agents is regulated due to their more or less damaging effect on humans and the environment that has become known, and since there are occupational exposure limits (OELs) which must be adhered to with regard to the concentration in preparations (cf. for example classification of substances and preparations according to EC Directive 67/548/EEC including annual updates), VCI combinations containing excessive amounts of passivator can no longer be used.

Most of the VCI systems known to date, which contain simultaneously a nitrite and an amine, are also unable to provide the necessary reliability since they consume one another through chemical reactions. For instance, it has in the meantime been found that in particular the secondary amines and the compounds containing a cyclic nitrogen, such as for example morpholine and piperidine, which are introduced as VCI components are easily converted to N-nitroso compounds. These N-nitrosamines usually act as weak oxidation agents and promote the corrosion of the metals. Much more disadvantageous, however, is their carcinogenic effect, which prevents these VCI systems from being used on an industrial scale.

Specifically, when incorporating VCI combinations in mineral oils or synthetic oils, oxidation agents such as the nitrites are unsuitable in any case since they would cause a relatively quick oxidative decomposition of the base oil in question. Furthermore, the salts of the customary aliphatic and aromatic carboxylic acids which are known as VCIs are also not sufficiently soluble in oils. The formulations of VCI oils that have become known have therefore until now been limited mainly to the use of amines as VCI components (cf. for example: GB 919,778, GB 1,224,500, U.S. Pat. Nos. 3,398,095, 3,785,975 and JP 07145490 A). For instance, U.S. Pat. No. 3,398,095 claims mixtures which contain, besides sulphurised oleic acids, $C_6$ to $C_{12}$ alkylcarboxylic acids and $C_{20}$ to $C_{22}$ alkylsuccinic acids, additionally also dicyclohexylamine, morpholine, piperidine, hexylamine and/or phenyl-alpha-naphthylamine, while U.S. Pat. No. 3,785,975 highlights amine salts of diesters of ortho-phosphoric acid combined with alkenyl-substituted succinic acids, esters of unsaturated fatty acids, alkylcarboxylic acids, such as octanoic acid and morpholine as corrosion-inhibiting additives. Finally, JP 07145490 A claims preparations containing ethanolamine carboxylates, morpholine, cyclohexylamine and various sulphonates. However, since it is certain nowadays that said longer-chain carboxylic acids, like the esters of fatty acids and the sulphonates, do not evaporate from the customary mineral oils and synthetic oils at temperatures<80° C. under normal conditions, only the amines can be emitted from such preparations and become active as VCI components.

However, VCI oils from which only amines are emitted in the temperature range of interest of up to 80° C. are suitable only for the VCI corrosion protection of iron-based materials. In the case of zinc and aluminium, they are known to cause together with condensed water usually an excessive alkalisation of the surfaces, as a result of which considerable corrosion appears with the formation of zincates or aluminates, before finally the hydroxides and basic carbonates appear, which are usually known by the term "white rust". By contrast, copper materials under the effect of amines frequently suffer from corrosion with the formation of Cu-amine complexes.

DETAILED DESCRIPTION OF THE EMBODIMENTS OF THE INVENTION

In order to satisfy the demand for VCI-equipped oils for managing the temporary corrosion protection of ferrous and nonferrous metals containing design-induced small cavities, VCI systems which are free of amines and oxidation agents are required. Particularly of interest are preparations which can be processed not only to form a VCI oil but rather also to form VCI dispensers (mixtures of VCI components in bags or capsules) and to form coated VCI packaging materials (e.g. papers, cardboards, foams). By using combinations of such VCI products, which in each case contain identical active substances and are thus compatible with one another without restriction, it is possible to produce particularly effective and long-lasting VCI corrosion protection packagings, e.g. preserving packagings for engine blocks treated with the VCI oil inside lid-covered trays in which VCI-emitting bags, capsules or VCI-coated paper or foam blanks are additionally incorporated in order to ensure saturation of the gas space of the tray in question with the VCI components, even when stored for long periods of time, as a condition for maintaining the VCI corrosion protection.

The object of the invention is to provide corrosion-inhibiting substances and substance combinations capable of evaporating or sublimating which are improved compared to the above-mentioned disadvantages of conventional volatile corrosion inhibitors that act via the vapour phase, which substances and substance combinations, both as a powder mixture and incorporated in coatings and particularly in oils, evaporate or sublimate under the climatic conditions of interest in practice within technical packagings and similar closed spaces at a sufficient rate from the corresponding depot, e.g. a bag containing the VCI components, a coating containing the VCI components on a carrier such as paper, cardboard or foam, or an oil containing the VCI components, and, after adsorption and/or condensation on the surface of metals located in this space, ensure conditions under which the customary utility metals are reliably protected against atmospheric corrosion. The object of the invention is also to provide methods for producing and processing such substances and substance combinations for the production of improved VCI packaging materials.

Surprisingly, these objects were able to be achieved in particular by providing the substance combinations according to claims 1 and 2. More specific aspects and preferred embodiments of the invention form the subject matter of the further claims.

The substance combination according to the invention comprises the following components:

(1) at least one substituted, preferably polysubstituted, pyrimidine, (2) at least one monoalkylurea, (3) at least one $C_3$ to $C_5$ aminoalkyldiol.

It has been found according to the invention that the combination of the above components (1)-(3) results in a good corrosion-inhibiting effect for many metals.

The corrosion-inhibiting substance combination according to the invention preferably also contains a further component (4), namely a benzotriazole, preferably a benzotriazole which is substituted on the benzene ring. This component is particularly advantageous for protecting copper and copper alloys, but also offers advantages for protecting other utility metals.

The proportions by weight of the various components may vary depending on the specific field of application, and suitable compositions can be ascertained without difficulty by a person skilled in the art in this field through routine experiments.

In one preferred embodiment of the invention containing all components (1) to (4), the corrosion-inhibiting substance combination contains 0.1 to 5% by weight of component (1), 0.2 to 12% by weight of component (2), 1 to 15% by weight of component (3) and 0.4 to 10% by weight of component (4).

Some suitable, non-limiting examples of a polysubstituted pyrimidine are 2,4-dihydroxy-5-methylpyrimidine (thymine), 2-amino-4-methylpyrimidine, 2-amino-4-methoxy-6-methylpyrimidine, 2-amino-4,6-dimethylpyrimidine (cytosine) or a mixture thereof. Further suitable pyrimidines can be determined without difficulty by the person skilled in the art through routine experiments. The term "polysubstituted" as used herein means two or more substitutions.

As an alternative or in addition to the polysubstituted pyrimidines, monosubstituted pyrimidines could also be used in the substance combination according to the invention. However, the corrosion-protecting effect thereof is generally much lower than that of the polysubstituted pyrimidines.

Some suitable, non-limiting examples of the monoalkylurea are N-butylurea, N-hexylurea, N-benzylurea, N-cyclohexylurea or a mixture thereof. As can be seen from the above examples, the term "monoalkylurea", as used here, also encompasses cycloalkyl- and aralkyl-monosubstituted ureas. In contrast to the monoalkylurea used according to the invention, however, the use of an unsubstituted or disubstituted urea leads to much poorer results and does not provide satisfactory VCI corrosion protection.

Some suitable, non-limiting examples of the $C_3$ to $C_5$ aminoalkyldiol are 2-amino-2-methyl-1,3-propanediol, 2-amino-3-methyl-1,4-butanediol, 2-amino-2-methyl-1,4-butanediol, or a mixture thereof. Further suitable aminoalkyldiols can be determined without difficulty by the person skilled in the art through routine experiments.

Some suitable, non-limiting examples of the benzotriazole are unsubstituted benzotriazole, a benzotriazole alkylated, preferably methylated, on the benzene ring, preferably 5-methylbenzotriazole, or a mixture of methylbenzotriazoles (referred to here as tolyltriazole).

In the corrosion-inhibiting substance combination according to the invention, components (1) to (3) or (1) to (4) are present in mixed form or dispersed in water or pre-mixed in a solubiliser that is miscible in any ratio with mineral oils and synthetic oils.

Preferably, this solubiliser is a phenyl alkyl alcohol and/or alkylphenol, in which the components are present in dissolved or dispersed form.

Some suitable, non-limiting examples of the phenyl alkyl alcohol are a benzyl alcohol, 2-phenylethanol, methylphenylcarbinol, 3-phenylpropanol or a mixture thereof.

Some suitable, non-limiting examples of the alkylphenol are di-tert-butyl-4-methylphenol, 2,6-di-tert-butyl-4-ethylphenol, 2,6-di-tert-butyl-4-methoxyphenol, 2,6-di-octadecyl-4-methylphenol, 2,4,6-tri-tert-butylphenol or a mixture thereof.

The corrosion-inhibiting substance combinations according to the invention may contain, besides components (1) to (3) or (1) to (4) according to the invention and optionally the solubiliser, additionally also substances that have already been introduced as vapour phase corrosion inhibitors, individually or as a mixture thereof.

A substance combination according to the invention may be produced for example in that components (1) to (3) or (1) to (4) are mixed with one another in the desired proportions (plus any additional components).

In one preferred embodiment, 0.1 to 5% by weight of component (1), 0.2 to 12% by weight of component (2), 1 to 15% by weight of component (3) and 0 to 10% by weight, preferably 0.4 to 10% by weight, of component (4) are mixed with one another in this method.

In a further method for producing a corrosion-inhibiting substance combination capable of evaporating or sublimating, the corrosion-inhibiting components (1) to (3) or (1) to (4) are first mixed with one another and then dissolved or dispersed in water or in a solubiliser that is miscible in any ratio with mineral oils and synthetic oils.

The composition of the corrosion-inhibiting substance combinations according to the invention is preferably set in such a way that all the components sublimate in the temperature range up to 70° C. at relative humidities (RH)≤98% in a quantity and at a rate sufficient for protecting the vapour space against corrosion.

According to the invention, these substance combinations are used directly in the form of appropriate mixtures or are incorporated by known methods during the production of VCI packaging materials and oil preparations so that these packaging materials or oils act as a VCI depot and the corrosion protection properties of the substance combinations according to the invention can unfold in a particularly advantageous manner.

In order to incorporate the substance combinations according to the invention in VCI depots or in packaging materials and oils that act as such, it is advantageous first to mix the individual substances in the anhydrous state with one another as intensively as possible using methods known per se.

In one embodiment, the corrosion-inhibiting substance combinations are used as volatile corrosion inhibitors (VPCIs, VCIs) in the form of finely powdered mixtures in the packaging, storage or transport of metal materials.

However, the corrosion-inhibiting substance combinations can also be incorporated in coating substances and coating solutions, preferably in an aqueous/organic medium, and/or colloidal composite materials in order thus to coat carrier materials, such as paper, cardboard, foams, textile woven, textile nonwoven and similar 2-dimensional extended entities or fabrics in the context of producing VCI-emitting packaging materials, and then to use these within packaging, storage and transport processes.

In another embodiment, the corrosion-inhibiting substance combinations are used to produce VCI corrosion protection oil, from which vapour phase corrosion inhibitors (VPCIs, VCIs) are emitted.

Preferably, such a VCI corrosion protection oil comprises a mineral oil or synthetic oil and 2 to 10% by weight, relative to the oil phase, of a corrosion-inhibiting substance combination according to the invention in a solubiliser, and the composition is set in such a way that all the corrosion inhibitor components evaporate or sublimate from the VCI oil in the temperature range up to 70° C. at relative humidities (RH) ≤98% in a quantity and at a rate sufficient for protecting the vapour space against corrosion.

The substance combinations according to the invention and the VCI oils containing the same are used primarily to protect against atmospheric corrosion the broad range of customary utility metals, including iron, chromium, nickel, tin, zinc, aluminium, magnesium and copper and alloys thereof, in packagings, during transport and during storage in closed spaces. In this case, the metal parts to be protected advantageously need not be directly coated with the respective substance combination or the oil.

The substance combinations according to the invention are free of nitrites and cycloalkylamines and advantageously consist only of substances which can be processed easily and without risk by methods known per se and which can be classified as non-toxic and non-hazardous to the environment in the quantities to be used. They are thus particularly suitable for producing anti-corrosion packaging materials which can be used on a large scale inexpensively and without any potential risk.

The subject matter of the application will be explained in more detail by the following, non-limiting examples. As is also clear therefrom, the type and quantity of the individual components in the mixture according to the invention and the quantity of the mixture in the respective VCI depot depend only on the conditions under which the VCI-emitting product in question is produced, and not on the type of metal to be protected against corrosion.

EXAMPLES

Example 1

The following substance combination VCI (1) was prepared from the anhydrous substances:

2.0% by weight 2-amino-4-methoxy-6-methylpyrimidine
12.0% by weight cyclohexylurea
15.0% by weight 2-amino-2-methyl-1,4-butanediol
6.0% by weight tolyltriazole (isomeric mixture of methylbenzotriazoles)
15.0% by weight 2,6-di-tert-butyl-4-methylphenol
50.0% by weight inert filler (silica gel)

In each case 5 g of this mixture were broadly distributed on the bottom of a 25 ml glass beaker and the latter was placed in a glass jar (capacity 1 l). A second glass beaker containing 10 ml of deionised water was positioned next to the first glass beaker. A test body frame made from PMMA was then introduced, on which in each case 4 cleaned test bodies had been positioned in a manner inclined at 45° to the horizontal. In each batch, these test bodies consisted of the materials low-alloyed steel 100Cr6, cast iron GGG25, steel plated with fine particles of zinc comprising a zinc layer of 17 μm, and electrolytic copper (E-Cu), free of tarnish films and deposits.

The glass jars containing the metal samples, the deionised water and the substance combination according to the invention were tightly closed, for which use was made in each case of a lid comprising a sealing ring and a tension clip. After a waiting time of 16 h at room temperature, the so-called build-up phase of the VCI components within the vessel could be considered to be complete. The individual glass jars were then exposed to 40° C. for 16 h in a heated cabinet, then left for a further 8 h at room temperature. This cyclic loading (1 cycle=24 h) was repeated until visual changes could be seen on the test bodies through the glass wall or until a maximum load of 40 cycles had been achieved.

After the end of the test, the test bodies were visually assessed in detail outside the glass jars.

As a reference for the substance mixture VCI (1) according to the invention, 5 g portions of a commercially available VCI powder were tested in the same way. This reference VCI powder (R1) consisted of:

54.0% by weight monoethanolamine benzoate
23.0% by weight 1H-benzotriazole
23.0% by weight filler (silica gel)

Result of the Test:

The test bodies that had been used together with the substance mixture VCI (1) according to the invention had an unchanged appearance after 40 cycles in all 4 parallel batches.

In the batches using the commercially available reference system R1, the test bodies made from GGG25 exhibited first spots of rust after 8 to 10 cycles, and these spots quickly increased in size as the test continued. On the steel rings, rust at the edges could be observed after 11 to 12 cycles.

The test bodies made from zinc-plated steel exhibited clear signs of white rust both in the edge regions and on the surfaces after 42 cycles, which were able to be identified as basic zinc carbonate ($2\ ZnCO_3 \times 3\ Zn(OH)_2$) by FTIR microscopy (PerkinElmer FTIR measuring station Spectrum One FTIR with Auto-Image microscope system in conjunction with a diamond cell).

The reference system R1 is therefore suitable only for the VCI corrosion protection of Cu base materials. In comparison thereto, the VCI effect of the substance combination VCI (1) according to the invention on the customary utility metals is very advantageously apparent from the described example.

Example 2

100 grams of the following substance combination according to the invention were prepared from the anhydrous substances:

5.0% by weight 2-amino-4-methylpyrimidine
10.0% by weight N-butylurea
15.0% by weight 2-amino-2-methyl-1,3-propanediol
25.0% by weight benzotriazole
5.0% by weight ammonium benzoate
40.0% by weight sodium benzoate and were dispersed with stirring and with slight heating (45±5)° C. in 900 grams of an aqueous-ethanolic solution consisting of 700 grams of deionised water and 200 grams of technical-grade ethanol.

Paper strips (Kraft paper 70 g/m$^2$) were coated with this composition, a wet application of 15 g/m$^2$ being carried out. Immediately after the VCI paper VCI (2) according to the invention thus produced had dried in air, it was tested with regard to its corrosion-protecting effect in comparison to a commercially available corrosion protection paper serving as the reference system (R2). According to chemical analysis, the reference system (R2) contained the active substances ethanolamine benzoate, sodium benzoate/benzoic acid, benzotriazole and urea, the total quantity being approximately twice as high as the substance combination according to the invention.

In a manner analogous to Example 1, test bodies made from low-alloyed steel 100Cr6, cast iron GGG25, steel coated with fine particles of zinc comprising a zinc layer of 17 μm, and electrolytic copper (E-Cu) were again used, and the test ritual was also analogous to that described in Example 1. The only difference was that, instead of the VCI powder mixtures, the individual glass jars were now lined with the VCI paper, in each case 1 circular blank of Ø 8 cm at the bottom, a lateral surface of 13×28 cm and another circular blank of Ø 9 cm for the top. The test body frame and the glass beaker containing the deionised water were then put in place, the glass jar was closed and the climate loading as described in Example 1 was carried out.

However, since the condition of the test bodies could no longer be observed through the glass wall, the batches were briefly opened for this purpose after every 5th cycle during the room temperature phase. If no changes could be seen visually, the climate loading was continued in the described manner.

Result of the Test:

The various test bodies that had been used together with the VCI paper VCI (2) produced on the basis of the substance mixture according to the invention had an unchanged appearance after 40 cycles in all 3 parallel batches.

In the batches using the commercially available reference system R2, the test bodies made from GGG25 exhibited first spots of rust during the inspection after 10 cycles, and these spots quickly increased in size as the test continued. On the steel rings, rust at the edges could be observed after 15 cycles.

The test bodies made from zinc-plated steel exhibited first signs of white rust at the edges after 15 cycles, which considerably increased in size as the loading continued, so that the test bodies were completely covered after 42 cycles. After 42 cycles, the test bodies made from Cu—SF were covered with a slight dark-grey tarnish film that could not be wiped off.

The reference system R2 is therefore suitable only for the VCI corrosion protection of Cu base materials to some extent, while the VCI paper VCI (2) produced on the basis of the substance combination according to the invention, as shown in the example, exhibits reliable VCI properties on the customary utility metals over long-term loading even under the extreme humidity conditions.

Example 3

The following substance combination according to the invention was prepared from the anhydrous substances:

0.3 parts by weight of 2-amino-4-methylpyrimidine
2.5 parts by weight of N-benzylurea
3.5 parts by weight of 2-amino-2-methyl-1,3-propanediol
1.7 parts by weight of 5-methylbenzotriazole and was stirred into 52 parts by weight of benzyl alcohol at a temperature of (60±5)° C. in order to produce an oil-miscible concentrate of these corrosion inhibitors. The resulting clear solution was finally added to 940 parts by weight of a commercially available mineral oil, resulting in the VCI oil VCI (3) according to the invention which was characterised by a mean viscosity of 35±10 $mm^2/s$ (40° C.)

To test the efficacy, test bodies made from low-alloyed steel 100Cr6, cast iron GGG25, steel coated with fine particles of zinc comprising a zinc layer of 17 μm, and electrolytic copper were used once again in a manner analogous to Example 1, and the test ritual was also analogous to that described in Example 1.

The main difference was that the test body frames made from PMMA were now equipped in each case with 3 pieces of one and the same type of test body, and the test sheet positioned in the middle was covered on both sides with the VCI oil according to the invention while the test bodies arranged at a distance of approx. 1 cm on each side thereof were used in the unoiled state. It was thus possible to ascertain the extent to which the oil film applied to the test body arranged in the middle is able to protect against corrosion both the directly contacted metal substrate and also, by the emission of the VCI components via the vapour phase within the closed glass jar, the two test bodies not coated with an oil film.

Each glass jar (capacity 1 l) contained, in addition to said 3 test bodies, once again also a glass beaker filled with 10 ml of deionised water. After the individual glass jars had been closed, the climate loading as described in Example 1 was once again carried out.

The individual batches were in each case briefly opened after every 5th cycle during the room temperature phase, and the condition of the test bodies was visually assessed. If no changes could be seen, the climate loading was continued in the described manner.

As a reference for the VCI oil VCI (3) according to the invention, a commercially available VCI oil of approximately the same mean viscosity was tested in an analogous manner. According to chemical analysis, this reference VCI oil R3, likewise formulated on the basis of a mineral oil, contained the active substances:

11.5 g/kg dicyclohexylamine
15.0 g/kg diethylaminoethanol
35.5 g/kg 3,5-trimethylhexanoic acid.

When this was used, the procedure was carried out in the same way. In each case the test body arranged in the middle was coated with this reference VCI oil R3 and was introduced with 2 identical but unoiled test bodies within a test body frame into a glass jar.

Result of the Test:

The various test bodies, each being exposed to the cyclic humidity climate in an arrangement of one test body coated with the VCI oil VCI (3) according to the invention together with 2 identical, unoiled test bodies at a distance therefrom in a glass jar, had an unchanged appearance after 40 cycles in each of 2 parallel batches. The VCI oil VCI (3) according to the invention therefore provided good corrosion protection both for said metal substrates in direct contact and also for the test bodies not treated with oil, due to the VCI components emitted via the vapour phase.

In the batches using the commercially available reference system R3, the test bodies made from low-alloyed steel 100C exhibited no corrosion phenomena after 40 cycles both in the oiled and in the unoiled state. In contrast, the test bodies made from GGG25 remained free of rust during the 40 cycles only in the oiled state, while the unoiled surfaces of the test bodies, particularly on the side facing away from the oiled test body positioned in the middle, increasingly exhibited rust phenomena. The spots of rust seen thereon after 10 cycles considerably increased in number and size as the test continued.

The test bodies made from electrolytic copper and oiled with the reference oil R3 were free from visually perceptible changes after 40 cycles, while the unoiled test bodies were relatively evenly covered with a dark-grey tarnish film that could not be wiped off.

The changes observed on the test bodies made from steel coated with fine particles of zinc comprising a zinc layer of 17 μm were the most obvious during the exposure to humidity. While the oiled sheets had clearly started to exhibit white rust in the edge regions after 15 cycles, the unoiled test bodies were already covered with a matt grey film after 10 cycles, from which a light grey to white layer of white rust had formed as the exposure to humidity continued, as in Example 1, again detected using FTIR microscopy.

The reference system R3 is therefore suitable only for the VCI corrosion protection of steel, while the VCI oil VCI (3) according to the invention, as shown in the example, exhibits reliable VCI properties on all customary utility metals in long-term testing even under the extreme humidity conditions.

Example 4

The following substance combination according to the invention was prepared from the anhydrous substances:

0.5 parts by weight of 2-amino-4-methoxy-6-methylpyrimidine
3.1 parts by weight of cyclohexylurea
4.0 parts by weight of 2-amino-3-methyl-1,4-butanediol
1.4 parts by weight of 5-methylbenzotriazole
31.0 parts by weight of 2,6-di-tert-butyl-4-methylphenol and was processed by intensive mixing to form a homogeneous mixture of solids. The mixture thus produced was then added slowly at (55±5)° C. to 960 parts by weight of a commercially available mineral oil. After briefly heating the mixture to 75° C. and then cooling to room temperature, the VCI oil VCI (4) according to the invention was available as a clear liquid, likewise characterised by a mean viscosity of (35±10) $mm^2/s$ (40° C.)

The efficacy was tested in a manner analogous to Example 3, once again using test bodies made from low-alloyed steel 100Cr6, cast iron GGG25, steel coated with fine particles of zinc comprising a zinc layer of 17 μm, and electrolytic copper, using the same test ritual as described in Example 3. As a reference for the VCI oil VCI (4) according to the invention, once again a commercially available VCI oil of approximately the same mean viscosity was tested in an analogous manner. This was likewise formulated on the basis of a mineral oil, but according to chemical analysis contained the active substances:

96.0 g/kg morpholine
15.0 g/kg diethylaminoethanol
65.0 g/kg oleic acid
23.0 g/kg benzotriazole When this was used, the procedure was carried out in the same way. In each case the test body arranged in the middle was coated with this reference VCI oil (R4) and was introduced with 2 identical but unoiled test bodies within a test body frame into a glass jar.

Result of the Test:

The various test bodies, each being exposed to the cyclic humidity climate in an arrangement of one test body coated with the VCI oil VCI (4) according to the invention together with 2 identical, unoiled test bodies at a distance therefrom in a glass jar, had an unchanged appearance after 40 cycles in each of 2 parallel batches. The VCI oil VCI (4) according to the invention, like the VCI oil VCI (3) according to the invention, therefore provided good corrosion protection both for said metal substrates in direct contact and also for the test bodies not treated with oil, due to the VCI components emitted via the vapour phase.

In the batches using the commercially available reference system R4, the test bodies made from low-alloyed steel 100C and cast iron GGG25 likewise exhibited no corrosion phenomena after 40 cycles both in the oiled and in the unoiled state.

The test bodies made from electrolytic copper and oiled with the reference oil R4 were free from visually perceptible changes after 40 cycles, while the unoiled test bodies made from electrolytic copper once again were relatively evenly covered with a dark-coloured tarnish film that could not be wiped off.

The test bodies made from steel coated with fine particles of zinc comprising a zinc layer of 17 μm changed their appearance considerably during the exposure to humidity. Both the oiled and the unoiled sheets already exhibited signs of white rust on the surface after 10 cycles, which after 40 cycles was present as a relatively uniform white layer.

The reference system R4 is therefore suitable only for the VCI corrosion protection of iron-based materials, while the VCI oil VCI (4) according to the invention, as shown in the example, ensures a pronounced multi-metal protection by exhibiting reliable VCI properties on all customary utility metals in long-term testing even under the extreme humidity conditions.

Example 5

The following substance combination according to the invention was prepared from the anhydrous substances:

10 parts by weight of 2-amino-4-methylpyrimidine
40 parts by weight of N-butylurea
50 parts by weight of 2-amino-2-methyl-1,3-propanediol A coating solution was produced therewith, consisting of 15 parts by weight of said substance combination
65 parts by weight of deionised water
20 parts by weight of technical-grade ethanol A flat nonwoven material composed of cotton fibres (so-called absorbent cardboard) and having a thickness of 3 mm was coated with this coating solution, a wet application of 50 $g/m^2$ being carried out.

After drying, the chemical analysis of this VCI nonwoven VCI (5) according to the invention showed:

2-amino-4-methylpyrimidine: 1.9 g/kg=75 $\mu g/cm^2$
N-butylurea: 7.5 g/kg=300 $\mu g/cm^2$
2-amino-2-methyl-1,3-propanediol: 9.4 g/kg=375 $\mu g/cm^2$ Segments measuring (30×30×3) $mm^3$ were cut from this VCI cotton nonwoven VCI (5) produced by coating using a substance combination according to the invention. Sheets of the materials carbon steel DC03, cold-rolled, (90×50×1) $mm^3$ (Q-Panel, Q-Panel Lab Products, Cleveland, Ohio 44145 USA), steel coated with fine particles of zinc (ZnSt) comprising a zinc layer of 18 μm, and the aluminium alloy A17075 in each case of the same size as the DC03 sheets were arranged parallel to and at a distance of approx. 1 cm from one another within spacer frames made from the chemically inert plastic PMMA (polymethyl methacrylate) on both sides a segment of the VCI foam layer VCI (5) was placed, and these arrangements were tightly closed in each case separately in pre-manufactured bags made from PER-LD, 100 μm layer thickness, by welding the superposed side seams. With the positioning of the various test sheets in plastic spacer frames, it was ensured that the VCI components emitted from the two foam blanks could carry out their effect as intended only via the gas phase within the closed bags.

As the reference system (R5), use was made of a commercially available VCI chip material which consisted of cotton cellulose having a thickness of 3 mm and containing according to chemical analysis the active substances:

10.7 g/kg sodium nitrite
16.5 g/kg ethanolamine (2-aminoethanol)
66.1 g/kg caprylic acid (n-octanoic acid)
32.6 g/kg urea, in total an active substance quantity that is more than six times higher than the VCI components in the substance combination VCI (5) according to the invention.

Using segments of this VCI chip material (R5), identical packages were prepared as with the VCI cotton nonwoven VCI (5) according to the invention, by once again arranging said metal combinations in spacer frames and providing them on each side with a blank of the chip material (R5) likewise measuring (30×30×3) $mm^3$ and welding them into bags made from PE-LD film, 100 μm. As the reference system (R5'), identical packages were further prepared in which no VCI-emitting nonwoven material was positioned, in order to detect separately the extent of the corrosion protection effect attributable to the barrier effect of the 100 μm PE-LD film.

All of the prepared model packages were transiently stored for a further approx. 5 h at room temperature in order to ensure that an atmosphere saturated with VCI components had been set inside the packages prepared with the VCI chip segments (build-up phase!). They were then transferred into various climate-controlled test cabinets of the type VC 4033 (VÖTSCH Industrie-technik GmbH, D-72304 Balingen), which were set to the changing humidity/temperature climate according to DIN EN 60068-2-30. For the samples using VCI (5) and R5 that were to be tested, separate climate-controlled test cabinets were used in each case so as to rule out any mutual influencing of the exposed samples.

It is known that, during the applied climate loading, one 24 h cycle consists of the following stages: 6 h 25° C. and (RH)=98%, 3 h heating phase from 25 to 55° C. at (RH)=95%, 9 h 55° C. at (RH)=93% and 6 h cooling phase from 55 to 25° C. at (RH)=98% and 3 h 25° C. and (RH)=98%.

Experience has shown that this changing humidity/temperature loading well imitates the climatic conditions of overseas transport in an accelerated fashion.

The surfaces of the test sheets inside the film packaging were inspected through the transparent film material after each cycle (within the stable 25° C. phase). As soon as signs of corrosion could be seen on individual test sheets, the number of completed cycles was recorded and then the climatic loading was continued until all the test sheets of a model package were affected, or until the extent of the corrosion of individual test sheets could no longer be assessed by visual inspection through the film walls. After the end of the test, the packaging material was removed and the surface condition of each test sheet was subjected to a final assessment.

Result of the Test:

TABLE 1

Results of the changing humidity/temperature loading of model packages (mean cycle number values taken from 3 parallel samples in each case)

| Packages | Number of cycles according to DIN EN 60068-2-30 | Surface condition of the test sheets |
|---|---|---|
| R5' | 6 | DC03, first spots of rust in edge regions; |
| | 9 | ZnSt, spots of white rust in the edge region; |
| | 12 | Al 7075, small white spots on surfaces; |
| | 18 | climate loading stopped since corrosion phenomena were clearer on all sheets |
| VCI (5) | ended after 40 | All test sheets still free of visible changes |
| R5 | 12 | ZnSt, first white rust at edges; |
| | 18 | Al 7075, small white spots |
| | 26 | DC03, spots of rust, on ZnSt white rust distributed over the surfaces: climate loading stopped since further progress of corrosion on test sheets could no longer be assessed visually with certainty |

This example documents the superiority of the substance combination according to the invention as a high-performance VCI chip material for the corrosion protection of customary utility metals, while the reference system R5, despite a much higher active substance concentration, was able to have a satisfactory protective effect only on steel, whereas in the case of the non-ferrous metal samples hardly any differences could be seen compared to the VCI-free reference system R5' consisting of the package comprising a customary PE-LD film, 100 μm.

The invention claimed is:

1. A corrosion-inhibiting substance combination capable of evaporating or sublimating comprising:

at least one polysubstituted pyrimidine selected from the group consisting of: 2,4-dihydroxy-5-methylpyrimidine (thymine), 2-amino-4-methylpyrimidine, 2-amino-4-methoxy-6-methylpyrimidine, 2-amino-4,6-dimethylpyrimidine (cytosine), and a combination thereof;

at least one monoalkylurea: and at least one $C_3$ to $C_5$ aminoalkyldiol.

2. The corrosion-inhibiting substance combination according to claim 1, further comprising at least one benzotriazole, which is unsubstituted or substituted on the benzene ring.

3. The corrosion-inhibiting substance combination according to claim 1, in which the monoalkylurea is selected from the group consisting of: N-butylurea, N-hexylurea, N-benzylurea, N-cyclohexylurea, and a combination thereof.

4. The corrosion-inhibiting substance combination according to claim 1, in which the $C_3$ to $C_5$ aminoalkyldiol is selected from the group consisting of:

2-amino-2-methyl-1,3-propanediol, 2-amino-3-methyl-1,4-butanediol, 2-amino-2-methyl-1,4-butanediol, and a combination thereof.

5. The corrosion-inhibiting substance combination according to claim 2 wherein the benzotriazole is a benzotriazole methylated on the benzene ring, 5-methylbenzotriazole, or a mixture of methylbenzotriazoles.

6. The corrosion-inhibiting substance combination according to claim 2 comprising 0.1 to 5% by weight of polysubstituted pyrimidine, 0.2 to 12% by weight of monoalkylurea, 1 to 15% by weight of $C_3$ to $C_5$ aminoalkyldiol and 0.4 to 10% by weight of benzotriazole, which is unsubstituted or substituted on the benzene ring.

7. The corrosion-inhibiting substance combination according to claim 1, wherein the at least one polysubstituted pyrimidine, at least one monoalkylurea, and at least one $C_3$ to $C_5$ aminoalkyldiol are in a mixed form or dispersed in water or pre-mixed in a solubilizer that is miscible in any ratio with mineral oils and synthetic oils.

8. The corrosion-inhibiting substance combination according to claim 2, wherein the at least one polysubstituted pyrimidine, at least one monoalkylurea, at least one $C_3$ to $C_5$ aminoalkyldiol, and at least one benzotriazole, are in a mixed form or dispersed in water or pre-mixed in a solubilizer that is miscible in any ratio with mineral oils and synthetic oils.

9. The corrosion-inhibiting substance combination according to claim 7, wherein the corrosion-inhibiting substance combination is dissolved or dispersed in a phenyl alkyl alcohol and/or alkylphenol that is miscible in any ratio with mineral oils and synthetic oils.

10. The corrosion-inhibiting substance combination according to claim 8, wherein the corrosion-inhibiting substance combination is dissolved or dispersed in a phenyl alkyl alcohol and/or alkylphenol that is miscible in any ratio with mineral oils and synthetic oils.

11. The corrosion-inhibiting substance combination according to claim 1, in which all the components sublimate in the temperature range up to 70° C. at relative humidities (RH)≤98% in a quantity and at a rate sufficient for protecting the vapour space against corrosion.

12. The corrosion-inhibiting substance combination according claim 1, further comprising substances that have already been introduced as vapour phase corrosion inhibitors, individually or as a mixture thereof.

13. The corrosion-inhibiting substance combination according claim 2, further comprising substances that have already been introduced as vapour phase corrosion inhibitors, individually or as a mixture thereof.

14. An aqueous-organic coating solution, containing the corrosion-inhibiting substance combination according to claim 1, for fixing the corrosion inhibitors on a 2-dimensional extended carrier material such as paper, paperboard, cardboard, textile woven, textile nonwoven or foam.

15. A volatile corrosion inhibitors (VCI) corrosion protection oil, comprising a mineral oil or synthetic oil and 2 to 10% by weight, relative to the oil phase, of a corrosion-inhibiting substance combination according to claim 1 in a solubilzer, wherein all the corrosion inhibitor components evaporate or sublimate from the VCI oil in the temperature range up to 70° C. at relative humidities (RH)≤98% in a quantity and at a rate sufficient for protecting the vapour space against corrosion.

16. The corrosion-inhibiting substance combination according to claim 1, wherein said combination is in the form of finely powdered mixtures and used as a volatile corrosion inhibitor (VPCI, VCI) in the packaging, storage or transport of metal materials.

17. The corrosion-inhibiting substance combination according to claim 1, wherein said combination is incorporated in coating substances and coating solutions and/or colloidal composite materials.

18. The corrosion-inhibiting substance combination according to claim 1, wherein said combination is used for producing VCI corrosion protection oil, from which vapour phase corrosion inhibitors (VPCIs, VCIs) are emitted.

19. The corrosion-inhibiting substance combination according to claim 1, wherein said combination is used for protecting a utility metal, comprising iron, chromium, nickel, tin, zinc, aluminium, magnesium and copper and alloys thereof, against corrosion.

20. A corrosion-inhibiting substance combination capable of evaporating or sublimating comprising:

at least one polysubstituted pyrimidine;

at least one monoalkylurea; and at least one C3 to C5 aminoalkyldiol;

wherein the corrosion-inhibiting substance combination is dissolved or dispersed in a phenyl alkyl alcohol and/or alkylphenol that is miscible in any ratio with mineral oils and synthetic oils, wherein the phenyl alkyl alcohol is selected from the group consisting of benzyl alcohol, 2-phenylethanol, methylphenylcarbinol, 3-phenylpropanol and any combination thereof, and the alkylphenol is selected from the group consisting of di-tert-butyl-4-methylphenol, 2,6-di-tert-butyl-4-ethylphenol, 2,6-di-tert-butyl-4-methoxyphenol, 2,6-di-octadecyl-4-methyl-phenol, 2,4,6-tri-tert-butylphenol and any combination thereof.

21. A corrosion-inhibiting substance combination capable of evaporating or sublimating comprising:

at least one polysubstituted pyrimidine;

at least one monoalkylurea;

at least one C3 to C5 aminoalkyldiol; and at least one benzotriazole, which is unsubstituted or substituted on the benzene ring;

wherein the corrosion-inhibiting substance combination is dissolved or dispersed in a phenyl alkyl alcohol and/or alkylphenol that is miscible in any ratio with mineral oils and synthetic oils, wherein the phenyl alkyl alcohol is selected from the group consisting of benzyl alcohol, 2-phenylethanol, methylphenylcarbinol, 3-phenylpropanol and any combination thereof, and the alkylphenol is selected from the group consisting of di-tert-butyl-4-methylphenol, 2,6-di-tert-butyl-4-ethylphenol, 2,6-di-tert-butyl-4-methoxyphenol, 2,6-di-octadecyl-4-methyl-phenol, 2,4,6-tri-tert-butylphenol and any combination thereof.

22. A method for producing a corrosion-inhibiting substance combination capable of evaporating or sublimating, in which the corrosion-inhibiting components comprising:

at least one polysubstituted pyrimidine selected from the group consisting of: 2,4-dihydroxy -5-methylpyrimidine (thymine), 2-amino-4-methylpyrimidine, 2-amino-4-methoxy -6-methylpyrimidine, 2-amino-4,6-dimethylpyrimidine (cytosine), and a combination thereof, at least one monoalkylurea, at least one $C_3$ to $C_5$ aminoalkyldiol, and optionally, at least one benzotriazole, which is unsubstituted or substituted on the benzene ring, are mixed together and a solubilzer that is miscible in any ratio with mineral oils and synthetic oils.

* * * * *